US006615797B2

(12) United States Patent
Richard et al.

(10) Patent No.: US 6,615,797 B2
(45) Date of Patent: Sep. 9, 2003

(54) ENGINE SPEED CONTROL DEVICE AND METHOD

(75) Inventors: Francesco Richard, Rivoli (IT); Marco Tonetti, Turin (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 10/205,168

(22) Filed: Jul. 25, 2002

(65) Prior Publication Data

US 2003/0034006 A1 Feb. 20, 2003

(30) Foreign Application Priority Data

Jul. 27, 2001 (IT) ..... TO01A0752

(51) Int. Cl.[7] ..... F02D 31/00
(52) U.S. Cl. ..... 123/352; 701/110
(58) Field of Search ..... 123/352; 701/110

(56) References Cited

U.S. PATENT DOCUMENTS 4,771,848 A * 9/1988 Namba et al. ..... 123/352
6,018,694 A * 1/2000 Egami et al. ..... 701/110
6,336,070 B1 * 1/2002 Lorenz et al. ..... 701/110
6,343,586 B1 * 2/2002 Muto et al. ..... 701/110
6,347,275 B1 * 2/2002 Nakano ..... 701/110

* cited by examiner

*Primary Examiner*—Erick Solis
(74) *Attorney, Agent, or Firm*—Chapman and Cutler LLP

(57) ABSTRACT

There is described a control device for controlling the speed of an engine of a vehicle, and having a tracer block which receives a target engine speed indicating the desired engine speed, and a maximum engine torque, and supplies a reference engine speed indicating the behaviour of the engine speed during a transient speed state towards the target engine speed, and an open-loop torque indicating the drive torque which must be produced by the engine during the transient speed state for the engine speed to follow the reference engine speed; an observer block which receives a measured engine speed indicating the engine speed, and a combustion torque indicating the drive torque generated by fuel combustion, and supplies an observed engine speed representing an estimate of engine speed made on the basis of a system model and as a function of the combustion torque and the measured engine speed, and an observed resisting torque representing an estimate of the total resisting torque acting on the drive shaft of the engine and made as a function of the observed engine speed and the measured engine speed; and a controller block which receives the open-loop torque, the reference engine speed, the observed engine speed, and the observed resisting torque, and supplies the combustion torque; the controller block controlling the engine so that the drive torque generated by fuel combustion equals the combustion torque.

10 Claims, 6 Drawing Sheets

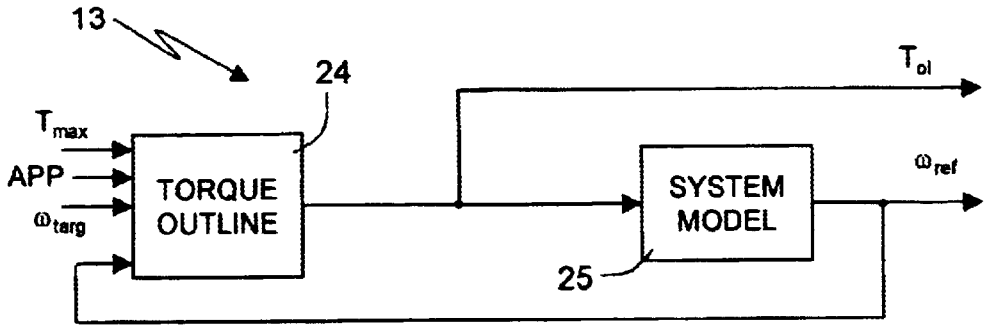
Fig.8
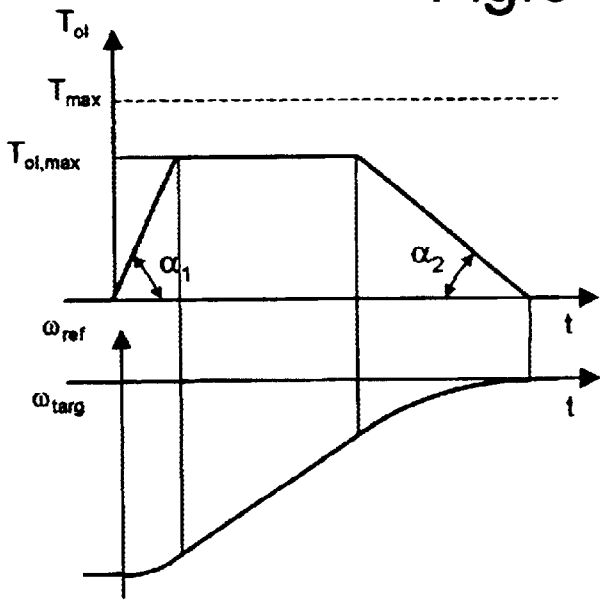
Fig.9
Fig.10
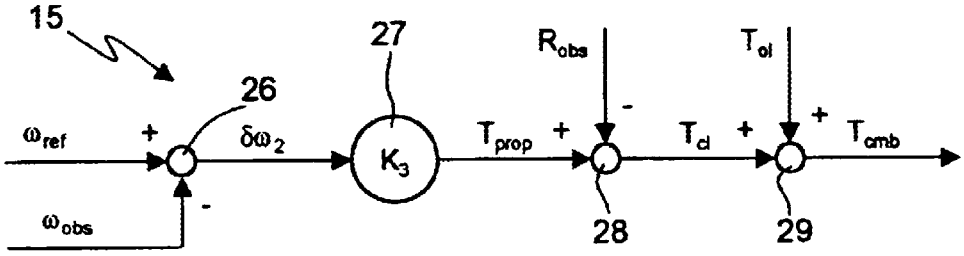
Fig.11
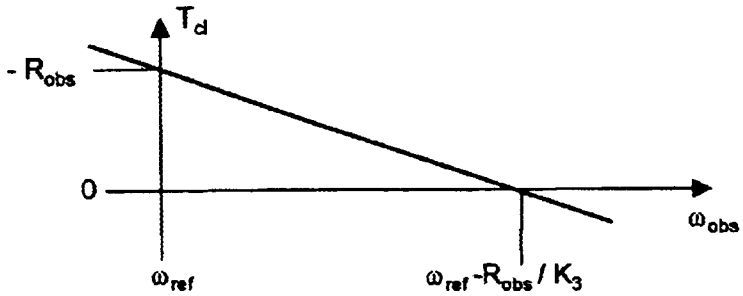
Fig.12

ENGINE SPEED CONTROL DEVICE AND METHOD

The present invention relates to an engine speed control device and method.

In particular, the present invention may be used to advantage, though not exclusively, for controlling the speed of a vehicle engine, to which the following description refers purely by way of example.

BACKGROUND OF THE INVENTION

As is known, in the automotive industry, ensuring maximum driving comfort of a vehicle during transient engine speed states is one of the hardest things to achieve.

This is particularly so in certain engine operating conditions, as, for example, when braking the vehicle running in gear at minimum engine speed, which produces increasingly severe shaking, and hence discomfort to the driver and passengers, as a result of the central control unit counteracting the brake-produced reduction in engine speed to keep the engine at minimum speed.

Other operating conditions resulting in driver and passenger discomfort in the form of jolting are when accelerating sharply after releasing the brake, or when the central control unit gradually brings the engine down to minimum speed when the accelerator pedal is released.

More specifically, when the accelerator pedal is released, engine speed normally tends to undershoot, i.e. fall slightly below minimum, only to return to minimum immediately after, thus resulting in jolting of the driver and passengers.

The engine speed control algorithms employed so far by central control units for the purpose of improving driving comfort provide for PI (proportional-integral) or PID (proportional-integral-derivative) control, and, besides being generally ineffective in eliminating the above drawbacks, comprise numerous calibration parameters enabling calibration purely by trial and error. At present, in fact, control algorithms are calibrated by first performing a series of road tests to determine performance of the vehicle in the above operating conditions, and then calibrating the control algorithm parameters substantially manually, trusting in the skill of technicians with many years' experience.

SUMMARY OF THE INVENTION

It is an object of the present invention to provide an engine speed control method and device designed to at least partly eliminate the aforementioned drawbacks.

More specifically, it is an object of the present invention to provide an engine speed control method and device which not only provide for significantly reducing driver and passenger discomfort in the above operating conditions, but which can also be calibrated by deterministic methods.

According to the present invention, there is provided an engine speed control device as claimed in claim 1.

According to the present invention, there is also provided an engine speed control method as claimed in claim 10.

BRIEF DESCRIPTION OF THE DRAWINGS

A preferred, non-limiting embodiment of the present invention will be described by way of example with reference to the accompanying drawings, in which:

FIG. 8 shows a more detailed block diagram of a tracer block forming part of the FIG. 5 control device;

FIGS. 9 and 10 show graphs of the FIG. 8 tracer block output during a transient speed state;

FIG. 11 shows a more detailed block diagram of a controller block forming part of the FIG. 5 control device;

FIG. 12 shows a graph of a quantity involved in the FIG. 11 controller block;

DETAILED DESCRIPTION OF THE INVENTION

For a clear understanding of the present invention, the following description includes various kinematic and system equations characteristic of the system defined by a vehicle and its power train, which, as is known, comprises the engine and drive train, which in turn is defined by the transmission, the clutch releasably connecting the transmission to the engine, and a final drive unit defined by the differential and axle shafts, and which connects the transmission to the vehicle wheels.

Figure 1:
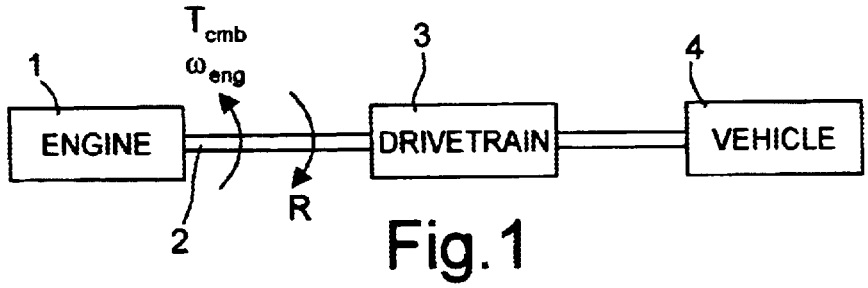
FIG. 1 shows a purely abstract block diagram of a system defined by a vehicle and relative power train.

For engine speed control purposes, the system defined by the vehicle and its power train may be represented purely abstractly as shown in the FIG. 1 block diagram, in which 1 indicates the engine, 2 the drive shaft, 3 the drive train, and 4 the rest of the vehicle.

As is known, fuel combustion generates a certain torque acting on the drive shaft and hereinafter referred to as combustion torque $T_{cmb}$. And if the system as a whole were perfectly rigid, engine speed $\omega_{eng}$ would be given by the following equation:

$$T_{cmb}-R=J_{sys}\cdot\omega_{eng} \quad 1)$$

where R is the total resisting torque acting on the drive shaft, and $J_{sys}$ is the moment of inertia of the controlled system calculated with respect to the drive shaft rotation axis.

The controlled system is actually defined not only by the drive shaft but also by all the parts connected mechanically to it, and therefore changes during operation of the vehicle. The drive train in fact comprises the clutch and transmission, which are normally controlled by the driver of the vehicle by means of the clutch pedal and gear lever.

Figure 2:
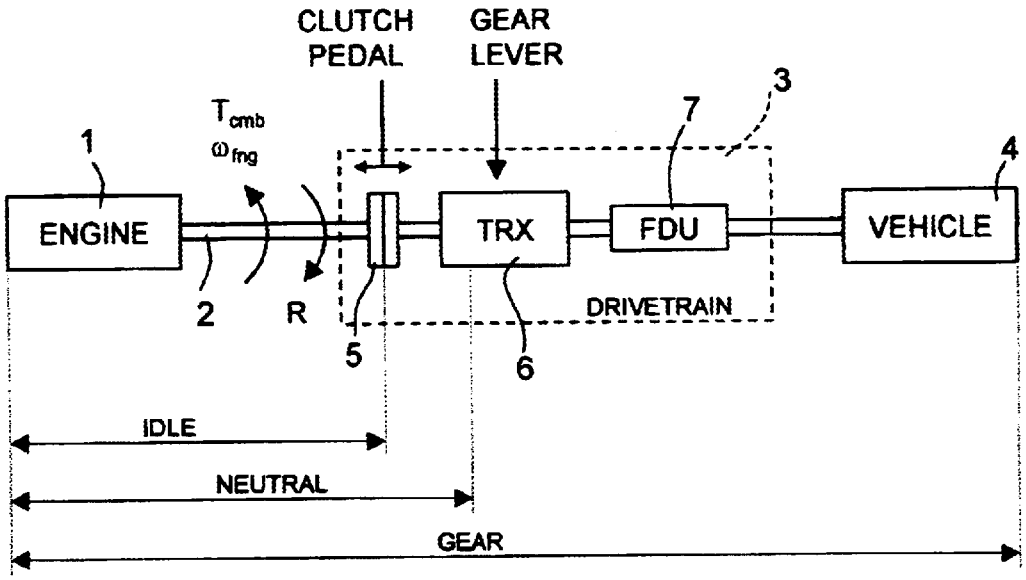
FIG. 2 shows a more detailed block diagram of the FIG. 1 system.

FIG. 2 shows a more detailed block diagram by which to represent the vehicle-power train system for the purpose of engine speed control, and in which 5 indicates the clutch, 6 the transmission, and 7 the final drive unit.

Depending on control by the driver, three main controlled system states can be distinguished:

a) idle: when the clutch is released; in which case, the controlled system is defined by the engine and drive shaft;

b) neutral: when the clutch is engaged and the transmission in neutral; in which case, the controlled system is defined by the engine, the drive shaft, and the main transmission shaft; and c) in-gear: when the clutch and a gear are engaged; in which case, the controlled system is defined by the engine, the drive shaft, the drive train, and the vehicle.

Within state c), since each gear has a different transmission ratio from the others, the controlled system changes depending on which gear is engaged.

R and $J_{sys}$ in equation 1) therefore change depending on the controlled system state.

The moment of inertia of the engine can be calculated roughly either theoretically, from design data, or by analysing the step response of the system in the idle state.

For passenger vehicle engines, it is normally $J_{eng} \in [0,1; 0,5]$ kg·m$^2$.

The moment of inertia of the drive train can be calculated from design data, and that of the vehicle by means of the following equation:

$$J_{veh} = \frac{4 \cdot J_{whl} + M_{veh} \cdot L_{whl}^2}{r^2} \qquad 2)$$

where $M_{veh}$ is the vehicle mass (one or two occupants should be included); $L_{whl}$ the wheel radius; and r the transmission ratio.

As shown clearly in equation 2), the moment of inertia of the vehicle depends on which gear is engaged. An accurate method of determining the engaged gear in a vehicle transmission is described later on.

The FIG. 1 system also involves various resisting torque components, which, in the case of the engine, include:

friction, which may roughly be modelled as a constant plus a viscous component proportional to engine speed; and accessory resistances, the effect of which can be modelled as a constant resisting torque. Some accessory resistances are "switched on" by the central control unit, so the corresponding resisting torque, if known, can be compensated in advance. On others, however, no information is available, so that no instantaneous compensation is possible.

The drive train, on the other hand, involves only friction which, in this case too, can be roughly modelled as a constant plus a viscous component proportional to engine speed.

As for the vehicle, this involves;

rolling resistance, which is substantially constant with rare but unpredictable variations;

aerodynamic drag, which is proportional to the square of vehicle speed, and therefore of engine speed; and road slope resistance, which involves sudden, unpredictable, significant variations.

Figure 3:
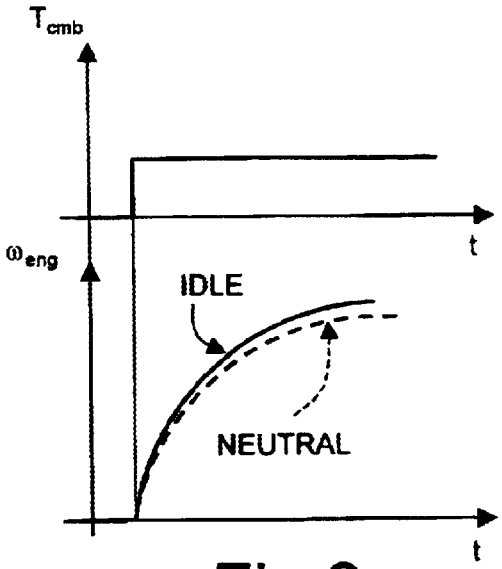
FIGS. 3 and 4 show the step response of the FIGS. 1 and 2 system.
Figure 4:
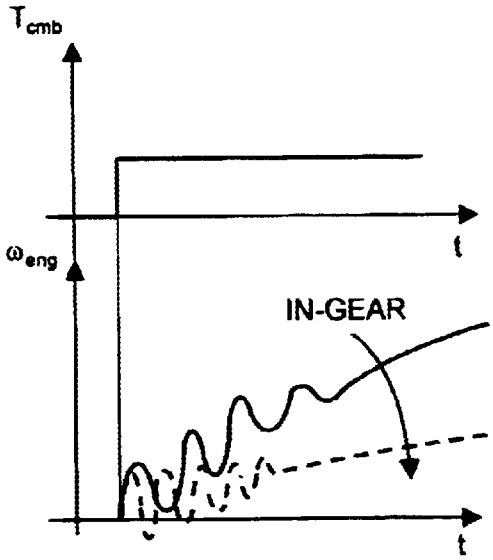

The dynamic behaviour of the FIGS. 1–2 system can be analysed on the basis of its step response, i.e. by first bringing the system to the steady state, and then immediately increasing the combustion torque $T_{cmb}$ by a given quantity. FIGS. 3 and 4 show engine speed $\omega_{eng}$ quality graphs in the above three states, i.e. idle, neutral, and in-gear.

More specifically, in all three states, the main step response dynamic is exponential (but with a different input-output gain), and a small oscillation, hereinafter referred to as "cycle dynamic", is noted.

In the in-gear state, a marked damped oscillation, hereinafter referred to as "drive train dynamic", is added to the main dynamic just after the input step.

More specifically, as regards the main dynamic, the exponential behaviour of the step response is caused by the moment of inertia of the system and by the variation with time of the resisting torque acting on the drive shaft.

Both the steady state and instantaneous gains depend on the system state and, in particular, decrease when passing from the idle to neutral and then to the in-gear state, and also decrease as the engaged gear is increased.

The main dynamic is similar to that obtained modelling the system as defined by a moment of inertia $J_{sys}$ and a viscous friction $\beta_{sys}$.

The drive train dynamic—which, as stated, is defined by damped oscillation of the step response in the in-gear state—is due to the elasticity of the drive train allowing part of the kinetic energy (and therefore engine speed oscillations) to pass continually from the engine to the vehicle and vice versa.

The drive train dynamic is damped naturally by the drive train itself. That is, at each passage through the drive train, said part of the kinetic energy is reduced by friction in the drive train itself.

The frequency and amplitude of the drive train dynamic depend on the gear engaged: as the transmission ratio increases, frequency increases and amplitude decreases.

The cycle dynamic is defined by a persistent small oscillation in engine speed easily noticeable in the steady state, and is due to unbalance of the engine cylinders, i.e. to significant differences in the combustion drive torques generated in the various engine cylinders (as a result, for example, of differing injector performance, etc.).

The frequency of the cycle dynamic depends on engine speed (seeing as how it has the same period as the engine cycle), while amplitude depends on the differences between the various engine cylinders.

In the light of the above, an engine speed control device in accordance with the present invention will now be described with reference to the FIG. 5 block diagram; the device providing, at minimum engine speed, for maintaining engine speed over and above a given minimum value, unless the driver of the vehicle decides otherwise, so as to prevent undesired shutdown of the engine, and for effectively controlling desired transient engine speed states at all other engine speeds.

More specifically, at minimum engine speed, it is an object of the control device according to the present invention to prevent engine speed from falling below a given minimum value—at the same time bearing in mind that the driver may wish engine speed to fall below said minimum value (as, for example, when braking in gear at minimum engine speed or when shifting to a higher gear), that driving comfort must be preserved, and that sudden variations in engine speed are normally to be avoided; which object is roughly achieved by increasing, if necessary, the combustion torque requested by the driver, but without exceeding the maximum drive torque producible by the engine.

Figure 5:
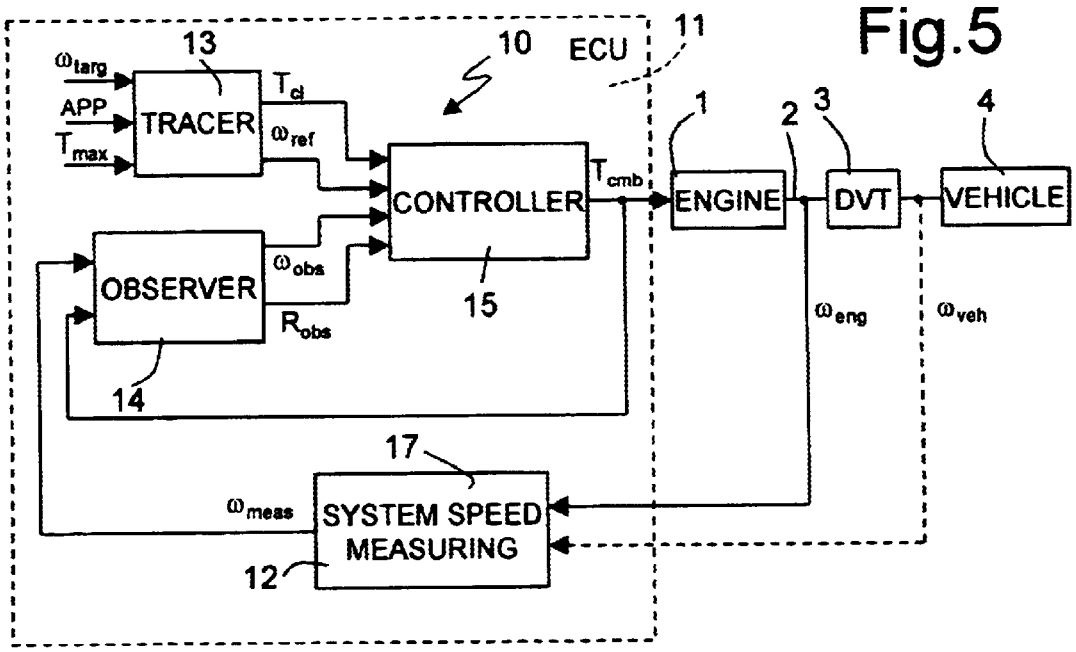
FIG. 5 shows a block diagram of an engine speed control device in accordance with the present invention.

With reference to FIG. 5, the engine speed control device according to the present invention is indicated as a whole by 10, and is implemented in the electronic central control unit (ECU) controlling the engine and vehicle and indicated 11. For the sake of clarity, FIG. 5 also includes the FIG. 1 block diagram.

Control device 10 substantially comprises four blocks: a system speed measuring block 12; a tracer block 13; an observer block 14; and a controller block 15.

More specifically, system speed measuring block 12 selects the most significant, most suitable engine speed $\omega_{eng}$ measurement, and, if necessary, processes the measured engine speed to reduce the dynamics which might possibly impair stability of the controlled system.

More specifically, system speed measuring block 12 comprises a first input receiving engine speed $\omega_{eng}$; a second input receiving the rotation speed of a final drive unit member—hereinafter referred to simply as vehicle speed $\omega_{veh}$; and an output supplying a measured engine speed $\omega_{meas}$; which may coincide with engine speed $\omega_{eng}$ or with vehicle speed $\omega_{veh}$, or may even be engine speed $\omega_{eng}$ filtered on the basis of a given criterion described in detail later on.

More specifically, engine speed $\omega_{eng}$ may, for example, be measured by a known measuring device connected to the drive shaft and defined by a pulse wheel fitted to the drive shaft, and by an electromagnetic sensor facing the pulse wheel and generating an electric signal indicating the speed and angular position of the pulse wheel.

More specifically, the engine speed measuring device supplies an engine speed value for each cylinder at the top dead-centre position of the relative piston, and each value is available immediately after half the drive shaft rotation to which it refers (180° engine angle).

Vehicle speed $\omega_{veh}$ on the other hand, indicates an alternative engine speed $\omega_{eng}$ to that supplied by the measuring device described above, and can be measured by any known measuring device connected, for example, to the axle shafts or to a rotary member on the differential. For reasons explained later on, vehicle speed $\omega_{veh}$ may even be dispensed with, and is therefore indicated by a dash line in FIG. 5.

Tracer block 13 controls the so-called restoring phases, i.e. transitions between various system states or between different target engine speed $\omega_{targ}$ values.

More specifically, tracer block 13 comprises a first input receiving a target engine speed $\omega_{targ}$ indicating the engine speed $\omega_{eng}$ to be achieved; a second input receiving a maximum engine torque $T_{max}$; a third input receiving the accelerator pedal position APP indicating the power demanded of engine 1; a first output supplying a reference engine speed $\omega_{ref}$ indicating the compulsory pattern of engine speed $\omega_{eng}$ during the transient speed state towards said target engine speed $\omega_{targ}$; and a second output supplying an open-loop torque $T_{ol}$ indicating the torque that must be produced instant by instant by engine 1 during the transient speed state for engine speed $\omega_{eng}$ to follow reference engine speed $\omega_{ref}$.

Observer block 14 makes a real-time estimate of engine speed and the total resisting torque acting on the drive shaft.

More specifically, observer block 14 comprises a first input receiving the measured engine speed $\omega_{meas}$ from system speed measuring block 12; a second input receiving combustion torque $T_{cmb}$; a first output supplying an observed engine speed $\omega_{obs}$ containing only a minimum part of the secondary dynamics of the system, i.e. those not being controlled and which impair performance and stability of the system; and a second output supplying an observed resisting torque $R_{obs}$ indicating the total resisting torque acting on drive shaft 2.

Controller block 15 comprises a first input receiving open-loop torque $T_{ol}$; a second input receiving reference engine speed $\omega_{ref}$; a third input receiving observed engine speed $\omega_{obs}$; a fourth input receiving observed resisting torque $R_{obs}$; and an output supplying combustion torque $T_{cmb}$.

Controller block 15 then controls engine 1, and in particular its injection system, so that the drive torque generated by engine 1 exactly equals combustion torque $T_{cmb}$.

Figure 6:
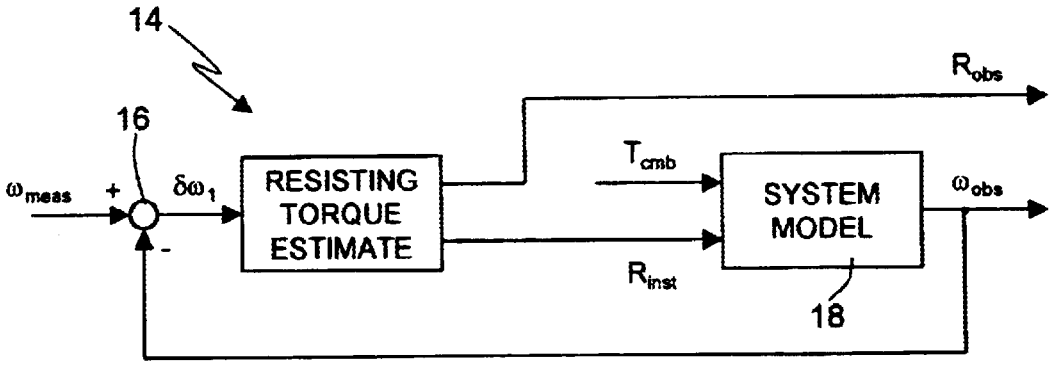
FIG. 6 shows a more detailed block diagram of an observer block forming part of the FIG. 5 control device.

FIG. 6 shows a more detailed block diagram of observer block 14.

As shown in FIG. 6, observer block 14 has an closed-loop structure in which the feedback quantity is defined by observed engine speed $\omega_{obs}$, which contains only the main dynamic and is supplied to controller block 15 to prevent instability of the controlled system.

More specifically, observer block 14 comprises an adding block 16 having a first input receiving measured engine $\omega_{meas}$, a second input receiving observed engine speed $\omega_{obs}$, and an output supplying an engine speed error $\delta\omega_1$ equal to the difference between measured engine speed $\omega_{meas}$ and observed engine speed $\omega_{obs}$; a resisting torque estimate block 17 having an input receiving engine speed error $\delta\omega_1$, a first output supplying observed resisting torque $R_{obs}$, and a second output supplying an instantaneous resisting torque $R_{inst}$ which, unlike observed resisting torque $R_{obs}$, takes into account the instantaneous variations in the resisting torque acting on drive shaft 2, e.g. caused by the vehicle wheels running over a hole or bump in the road; and a system model block 18 storing the behaviour model of the system defined by engine 1, drive train 3, and vehicle 4, and having a first input receiving combustion torque $T_{cmb}$, a second input receiving instantaneous resisting torque $R_{inst}$, and an output supplying the observed engine speed $\omega_{obs}$ supplied to the adding block.

More specifically, system model block 18 determines observed engine speed $\omega_{obs}$ as a function of the combustion torque $T_{cmb}$ of the engine and instantaneous resisting torque $R_{inst}$, according to the following equation:

$$\omega_{obs,i+1}=\omega_{obs,i}+g\cdot(T_{cmb,i}-R_{inst,i}) \quad 3)$$

where g is the system model gain.

Figure 7:
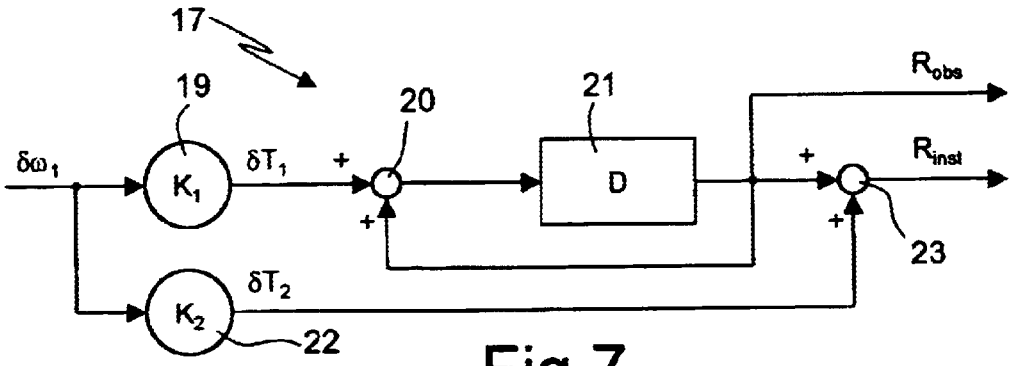
FIG. 7 shows a more detailed block diagram of a resisting torque estimator block forming part of the FIG. 6 observer block.

FIG. 7 shows a more detailed block diagram of resisting torque estimate block 17, which estimates the total resisting torque acting on the drive shaft as a function of the difference between measured engine speed $\omega_{meas}$ and observed engine speed $\omega_{obs}$.

The structure of the resisting torque estimate block shown in FIG. 7 is based on the assumption that the total resisting torque acting on the drive shaft remains constant during a sampling period, which is the same assumption on which PI (proportional-integral) control is based. In fact, in the steady state, the behaviour of observed resisting torque $R_{obs}$ is similar to that of the integral component of the PI control.

With reference to FIG. 7, resisting torque estimate block 17 comprises a first multiplication block 19 having an input receiving engine speed error $\delta\omega_1$, and an output supplying an observed resisting torque variation $\delta T_1$ equal to engine speed error $\delta\omega_1$ multiplied by a multiplication coefficient $K_1$; a first adding block 20 having a first input receiving observed resisting torque variation $\delta T_1$, a second input receiving observed resisting torque $R_{obs}$, and an output supplying an updated resisting torque $R_{up}$ equal to the observed resisting torque $R_{obs}$ plus observed resisting torque variation $\delta T_1$; and a delay block 21 having an input receiving updated resisting torque $R_{up}$, and an output supplying observed resisting torque $R_{obs}$.

Delay block 21, first adding block 20, and the feedback branch by which observed resisting torque $R_{obs}$ is fed back to first adding block 20, actually define a discrete adder by which, at each sampling instant, observed resisting torque $R_{obs}$ is updated with observed resisting torque variation $\delta T_1$.

Resisting torque estimate block 17 also comprises a second multiplication block 22 having an input receiving engine speed error $\delta\omega_1$, and an output supplying an instantaneous resisting torque variation $\delta T_2$ equal to engine speed error $\delta\omega_1$ multiplied by a multiplication coefficient $K_2$; and a second adding block 23 having a first input receiving observed resisting torque $R_{obs}$, a second input receiving instantaneous resisting torque variation $\delta T_2$, and an output supplying said instantaneous resisting torque $R_{inst}$ as the sum of observed resisting torque $R_{obs}$ and instantaneous resisting torque variation $\delta T_2$.

As can be seen, if engine speed error $\delta\omega_1$ is zero ($\delta\omega_1=0$), observed resisting torque $R_{obs}$ is taken to be correct and therefore maintained constant. Conversely, if engine speed error $\delta\omega_1$ is other than zero ($\delta\omega_1\neq 0$), engine speed error $\delta\omega_1$ is taken to be caused:

a) by a permanent variation in observed resisting torque $R_{obs}$ (or a permanent difference between the combustion torque demanded by the driver and the combustion torque actually obtained). This variation (difference) in torque is calculated by means of multiplication coefficient $K_1$:

$$\delta T_1 = K_1 \cdot \delta\omega_1 \quad 4)$$

Term $\delta T_1$ updates observed resisting torque $R_{obs}$ and will therefore continue to affect observed engine speed $\omega_{obs}$;

b) by an accidental variation in observed resisting torque $R_{obs}$ (or an accidental difference between the combustion torque demanded by the driver and the combustion torque actually obtained). This variation (difference) in torque is calculated by means of multiplication coefficient $K_2$:

$$\delta T_2 = K_2 \cdot \delta\omega_1 \quad 5)$$

Term $\delta T_2$, as opposed to updating observed resisting torque $R_{obs}$, only affects the next observed engine speed $\omega_{obs}$ value via instantaneous resisting torque $R_{inst}$, according to the equation.

$$R_{inst,i} = R_{obs,i} + \delta T_2 \quad 6)$$

Term $\delta T_2$ in fact is calculated to only correct instantaneous resisting torque $R_{inst}$, and therefore observed engine speed hobos in the event of said accidental variation, but not observed resisting torque $R_{obs}$, as explained previously.

Multiplication coefficients $K_1$ and $K_2$ are a function of the convergence time of observer block 14 and can be calculated using widely documented formulas (to be found in any in-depth text on automatic control theory).

FIG. 8 shows a more detailed block diagram of tracer block 13 for controlling the restoring phases, i.e. transitions between various system states or between different target engine speed $\omega_{targ}$ values.

As shown in FIG. 8, tracer block 13 has an open-loop structure, which is based on the assumption that the tracer block considers the system perfectly described by the system model.

More specifically, tracer block 13 comprises a torque outline block 24 having a first input receiving maximum engine torque $T_{max}$, a second input receiving target engine speed $\omega_{targ}$, a third input receiving reference engine speed $\omega_{ref}$, a fourth input receiving accelerator pedal position APP, and an output supplying open-loop torque $T_{ol}$ indicating, as stated, the torque to be supplied instant by instant by the engine for engine speed $\omega_{eng}$ to follow reference engine speed $\omega_{ref}$; and a system model block 25 identical with system model block 18 in FIG. 6, and having an input receiving open-loop torque $T_{ol}$, and an output supplying reference engine speed $\omega_{ref}$.

Given the above assumption whereby tracer block 13 considers the system perfectly described by the system model, it follows that, from the standpoint of tracer block 13, the angular speed of the system (i.e. the controlled quantity) is reference engine speed $\omega_{ref}$.

For this reason, torque outline block 24 operates by comparing reference engine speed $\omega_{ref}$ with target engine speed $\omega_{targ}$ to determine whether the system is to be accelerated or not.

If reference engine speed $\omega_{ref}$ differs from target engine speed $\omega_{targ}$ ($\omega_{ref}\neq\omega_{targ}$), torque outline block 24 starts a restoring phase and generates at its output an open-loop torque $T_{ol}$ with a trapezoidal time outline as shown in FIG. 9.

More specifically, the parameters defining the trapezoidal outline of open-loop torque $T_{ol}$—i.e. maximum value $T_{ol,max}$ (which is never higher than maximum engine torque $T_{max}$), slope $\alpha_1$ of the ascending portion, and slope $\alpha_2$ of the descending portion—constitute the characteristic parameters of tracer block 13, and are a function of the accelerator pedal position and the gear engaged.

More specifically, each characteristic parameter of tracer black 13 is assigned a permissible variation range defined by a minimum value and a maximum value, which are a function of the engaged gear and are determined by tests carried out by the maker; and the value of each characteristic parameter is determined by linear interpolation of the respective pair of minimum and maximum values as a function of the accelerator pedal position.

More specifically, if the accelerator pedal is not pressed (APP=0%), each characteristic parameter assumes the respective minimum value; if the accelerator pedal is pressed halfway (APP=50%), each characteristic parameter assumes the intermediate value between the respective minimum and maximum value; and if the accelerator pedal is pressed right down (APP=100%), each characteristic parameter assumes the respective maximum value.

For example, slopes $\alpha_1$ and $\alpha_2$ of the ascending and descending portions of the trapezoidal outline of open-loop torque $T_{ol}$ can be calculated using the following formula:

$$\alpha(APP\ \%) = \alpha_{\mathrm{MIN}} + \frac{\alpha_{\mathrm{MAX}} - \alpha_{\mathrm{MIN}}}{100} \cdot APP(\%$$

A similar formula can be used to calculate the maximum value $T_{ol,max}$ of open-loop torque $T_{ol}$.

The restoring phase ends when reference engine speed $\omega_{ref}$ reaches target engine speed $\omega_{targ}$, and open-loop torque $T_{ol}$ therefore equals zero, i.e.

$$\omega_{ref}=\omega_{min} \Rightarrow T_{ol}=0$$

which situation continues until one of the following occurs:

target engine speed $\omega_{targ}$ changes;

the system state changes and reference engine speed $\omega_{ref}$ is initialized with a different value.

If this again results in $\omega_{ref}\neq\omega_{targ}$, then tracer block 13 starts another restoring phase.

The corresponding reference engine speed $\omega_{ref}$ can be calculated using the following equation:

$$\omega_{ref,i+1}=\omega_{ref,i}+g \cdot T_{ol,i}$$

With the FIG. 9 torque outline, during the transient speed state, reference engine speed $\omega_{ref}$ passes from the value assumed before the start of the transient state to target engine speed $\omega_{targ}$ with an outline as shown in FIG. 10, which provides for a smooth restoring phase and, therefore, a transient speed state incurring no discomfort to the driver or passengers of the vehicle.

FIG. 11 shows a more detailed block diagram of controller block 15, which, as stated, is connected to tracer block 13 and observer block 14, and generates the combustion torque $T_{cmb}$ for obtaining the desired transient speed state.

More specifically, controller block 15 comprises a first adding block 26 having a first input receiving reference engine speed $\omega_{ref}$, a second input receiving observed engine speed $\omega_{obs}$, and an output supplying an engine speed error $\delta\omega_2$ equal to the difference between reference engine speed $\omega_{ref}$ and observed engine speed $\omega_{obs}$; a multiplication block 27 having-an input receiving engine speed error $\delta\omega_2$, and an output supplying a proportional torque $T_{prop}$ equal to engine speed error $\delta\omega_2$ multiplied by a multiplication coefficient $K_3$; a second adding block 28 having a first input receiving proportional torque $T_{prop}$, a second input receiving observed resisting torque $R_{obs}$, and an output supplying a closed-loop torque $T_{ol}$ equal to the difference between proportional torque $T_{prop}$ and observed resisting torque $R_{obs}$; and a third adding block 29 having a first input receiving closed-loop torque $T_{cl}$, a second input receiving open-loop torque $T_{ol}$, and an output supplying combustion torque $T_{cmb}$ as the sum of closed-loop torque $T_{cl}$ and open-loop torque $T_{ol}$.

As can be seen, combustion torque $T_{cmb}$ is the sum of two contributions:

a) closed-loop torque $T_{cl}$, which ensures observed engine speed $\omega_{obs}$ follows reference engine speed $\omega_{ref}$, and which in turn is the sum of two contributions:

a1) proportional torque $T_{prop}$, which is proportional to the difference between reference engine speed $\omega_{ref}$ and observed engine speed $\omega_{obs}$, i.e.

$$T_{prop}=K_3\cdot(\omega_{ref}-\omega_{obs})$$

where $K_3$ is the parameter defining the controller block;

a2) observed resisting torque $R_{obs}$, which, in the steady state, behaves the same way as the integral component of a proportional-integral closed-loop control;

b) open-loop torque $T_{ol}$, which ensures reference engine speed $\omega_{ref}$ follows target engine speed $\omega_{targ}$ during the restoring phase.

Like multiplication coefficients $K_1$ and $K_2$, coefficient $K_3$ is also a function of the convergence time of observer block 14 and can be calculated using widely documented formulas (to be found in any in-depth text on automatic control theory).

FIG. 12 shows the closed-loop torque $T_{cl}$ outline as a function of observed engine speed $\omega_{obs}$. As can be seen, when $\omega_{obs}=\omega_{ref}$, $T_{cl}=-R_{obs}$, i.e. no closed-loop acceleration/deceleration is requested.

As stated, a further aspect of the present invention is the way system speed measuring block 12 supplies measured engine speed $\omega_{meas}$ as a function of engine speed $\omega_{eng}$ and vehicle speed $\omega_{veh}$.

More specifically, engine speed $\omega_{eng}$ is a quantity supplied in real time by the relative measuring device at the top dead-centre positions of the respective cylinder pistons, and is available immediately after half the rotation of drive shaft 2 to which it refers (180° engine angle). Since, however, it contains all the dynamics, not only the main one, mentioned previously, to remove the undesired dynamics, it must be processed as described in detail below.

More specifically, the noise affecting engine speed $\omega_{eng}$ is manifested in the different individual engine speed values supplied by the relative measuring device at the respective top dead-center positions in each engine cycle, even when engine speed $\omega_{eng}$ is more or less constant within the engine cycle, and is normally caused by differing behaviour of the various engine components or the injection system, due, for example, to construction tolerances of the components, in particular the electroinjectors.

Vehicle speed $\omega_{veh}$, on the other hand, has no cycle dynamic and only a very small drive train dynamic, but is delayed with respect to engine speed $\omega_{eng}$, which is the controlled quantity, due to the elasticity of the drive train; and the delay is further increased by transmission time if the signal is made available over a CAN network.

In the light of the above, whether engine speed $\omega_{eng}$ or vehicle speed $\omega_{veh}$ is to be used by system speed measuring block 12 to generate measured engine speed $\omega_{meas}$ depends on the type of application. More specifically, in all applications in which vehicle speed $\omega_{veh}$ is an actual improvement over engine speed $\omega_{eng}$, i.e. when vehicle speed $\omega_{veh}$ is only slightly delayed with respect to engine speed $\omega_{eng}$, or the drive train dynamic it contains is substantially negligible, then measured engine speed $\omega_{meas}$ is defined by vehicle speed $\omega_{veh}$. In all other cases, i.e. when vehicle speed $\omega_{veh}$ is delayed excessively with respect to engine speed $\omega_{eng}$, or the drive train dynamic is significant, or when vehicle speed $\omega_{veh}$ is not measured on account of the relative measuring device not being provided, then measured engine speed $\omega_{meas}$ is a function of engine speed $\omega_{eng}$.

More specifically, according to one aspect of the present invention, in applications in which system speed measuring block 12 employs engine speed $\omega_{eng}$, the measured engine speed $\omega_{meas}$ supplied by system speed measuring block 12 is defined by engine speed $\omega_{eng}$ measured by the relative measuring device, when engine speed $\omega_{eng}$ is in a transient state, and is defined by engine speed appropriately filtered over a predetermined time window—hereinafter referred to as filtered speed $\omega_{filt}$—when engine speed $\omega_{eng}$ is in a substantially steady state.

More specifically, since, when engine speed $\omega_{eng}$ is in a transient state, the device measuring engine speed $\omega_{eng}$ supplies an engine speed $\omega_{eng}$ value for each cylinder at the top dead-centre position of the relative piston, and each value is available immediately after half the drive shaft rotation to which it refers, filtered speed $\omega_{filt}$ is generated by filtering engine speed $\omega_{eng}$ over a movable window of an amplitude corresponding to an engine cycle, i.e. filtered speed $\omega_{filt}$ is calculated as a mobile average of the last four values supplied by the measuring device.

The distinction between the transient state and substantially steady state of engine speed $\omega_{eng}$ is made on the basis of the derivative of filtered speed $\omega_{filt}$. More specifically, engine speed $\omega_{eng}$ is taken to be in a substantially steady state when the derivative of filtered speed $\omega_{filt}$ is below a given threshold value for at least one whole engine cycle. Otherwise, engine speed $\omega_{eng}$ is taken to be in a transient state.

In other words, engine speed $\omega_{eng}$ is taken to be in a substantially steady state if at least four successive values of the derivative of the mean engine speed $\omega_{eng}$ values are below said threshold value, which a function of the engaged gear.

It should be pointed out that a relationship exists between the steady or transient state of engine speed $\omega_{eng}$ and the operating condition of the engine. More specifically, the transient state of engine speed $\omega_{eng}$ coincides with the so-called transient engine speed state, while the substantially steady state of engine speed $\omega_{eng}$ coincides with the so-called steady engine speed state.

Figure 13:
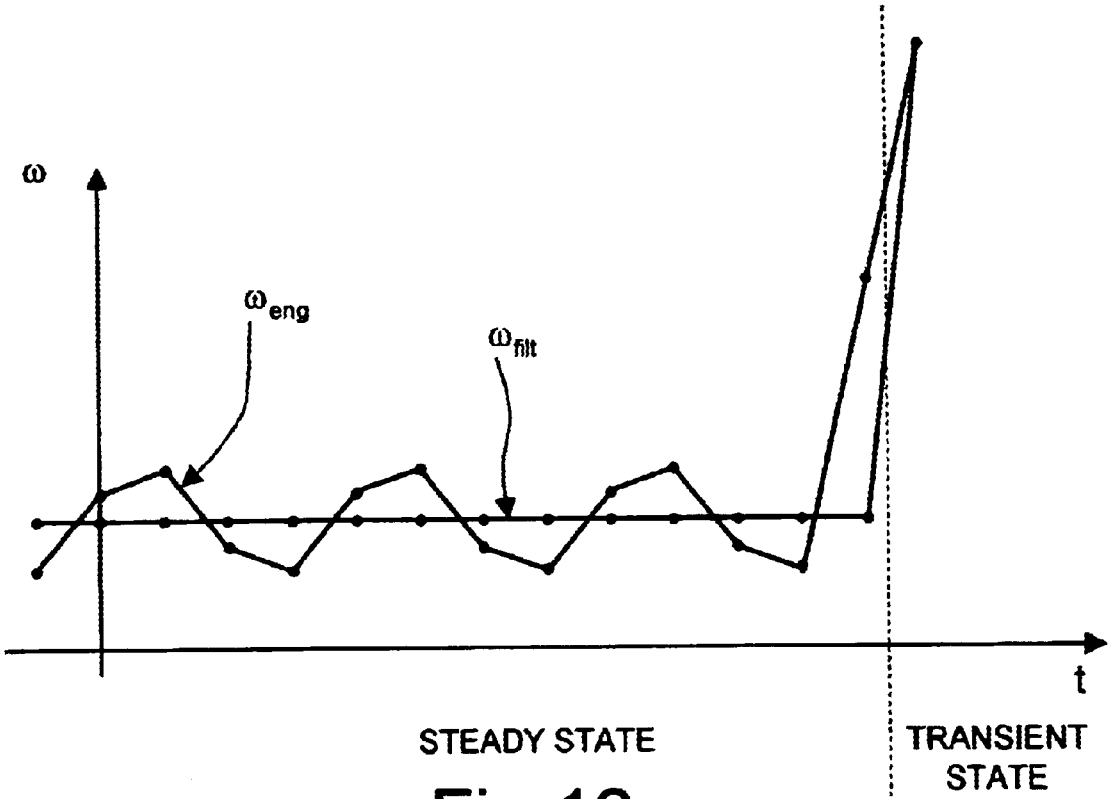
FIG. 13 shows a graph of engine speed and its mean value within the engine cycle.

FIG. 13 shows, by way of example, a graph of engine speed $\omega_{eng}$ measured by the relative measuring device, and filtered speed $\omega_{filt}$. More specifically, the dots on the engine speed $\omega_{eng}$ graph indicate the individual engine speed $\omega_{eng}$ values supplied by the measuring device at the top dead-centre positions of the relative cylinder pistons, while each dot on the filtered speed $\omega_{filt}$ graph indicates the mean value of the last four engine speed $\omega_{eng}$ values supplied by the measuring device.

Figure 14:
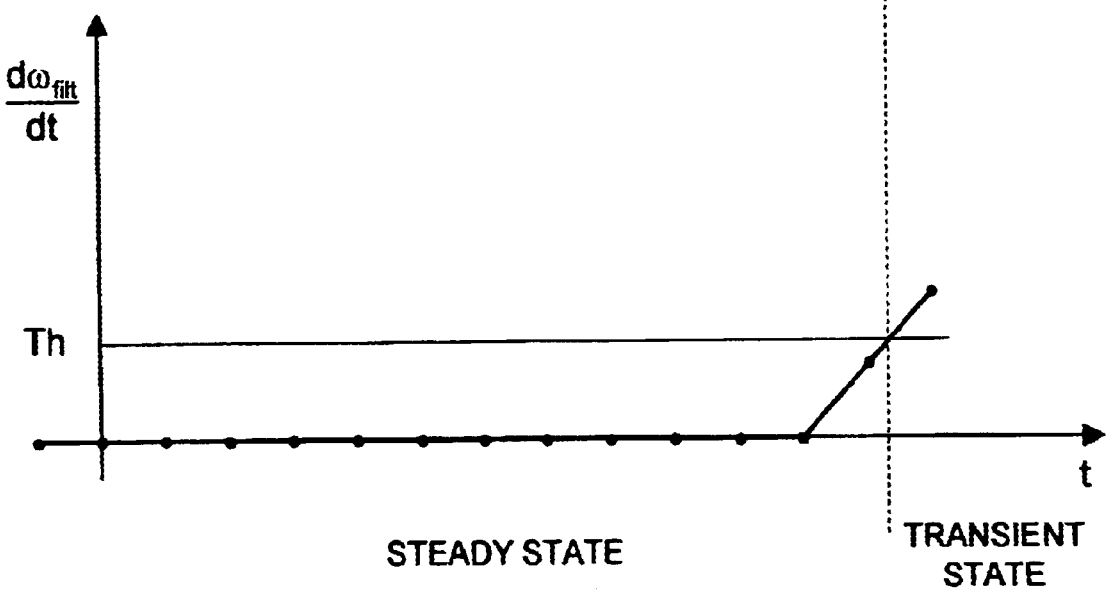
FIG. 14 shows a graph of the rate of change in engine speed.

FIG. 14 shows a graph of the filtered speed derivative $d\omega_{filt}/dt$; and the threshold value Th, depending on the engaged gear, used to distinguish between the transient state and substantially steady state of engine speed $\omega_{eng}$.

Generating measured engine speed $\omega_{meas}$ as described above, the observer block is supplied with filtered speed $\omega_{filt}$ when engine speed $\omega_{eng}$ is in the substantially steady state, to eliminate the dynamics which might impair the stability of the system, and the filtering delay has no effect on control by the system by virtue of the engine in this state operating at a speed at which the engine or vehicle operating quantities are substantially stable or undergo only slow variations not calling for rapid intervention of the system.

Conversely, when engine speed $\omega_{eng}$ is in the transient state, the observer block is supplied directly with engine speed $\omega_{eng}$ measured by the measuring device, so that the system is able to control the relative operating quantities in real time.

As stated in the introduction, engine speed $\omega_{eng}$ according to equation 1) describing the vehicle and power train from the system standpoint depends on the moment of inertia of the vehicle, which in turn depends on the vehicle transmission gear engaged.

The gear engaged is therefore one of the vehicle operating quantities which must be determined by the central control unit to control engine speed $\omega_{eng}$.

The following is a description of a perfected method of determining the vehicle transmission gear engaged.

As is known, for each engaged gear, the transmission has a respective nominal transmission ratio defined as the ratio between the rotation speed of the drive shaft and that of the output shaft of the transmission. This definition also applies when the clutch is released and no power is actually transmitted between the engine and transmission.

At present, the transmission gear engaged is determined directly by the electronic central control unit (ECU) by first calculating the ratio between the rotation speed of the drive shaft and that of the output shaft of the transmission; comparing the calculated transmission ratio with a number of transmission ratio ranges or bands, each centred about a respective nominal transmission ratio of a respective gear; and, finally, determining the gear by determining which transmission ratio band contains the calculated transmission ratio.

More specifically, the transmission ratio bands are contiguous and successive, and each of an amplitude depending on the respective gear and which normally equals roughly ±20% of the respective nominal transmission ratio.

Though widely used, the above method of determining the engaged gear has a major drawback preventing it from being fully exploited.

More specifically, some of the algorithms employed by the central control unit—in particular, those controlling the various operations involved in shifting gear—need to know, when shifting gear, when the transmission passes through the neutral state in which no gear is engaged; which is practically impossible to know, given the contiguous arrangement of the transmission bands.

One proposal to overcome this drawback—and which in some cases has actually been implemented—is to narrow down the transmission ratio bands so they are detached, i.e. non-contiguous, and so form, between each pair of adjacent transmission ratio bands, a band which, not relating to a transmission ratio, can be related to the neutral state.

In this way, when shifting gear, as the transmission ratio calculated by the central control unit passes from the previously occupied to the adjacent transmission ratio band, it passes through a neutral band, thus enabling the relative neutral state to be determined.

Though successfully enabling passage through the neutral state to be determined when shifting gear, this solution also has a drawback preventing it from being fully exploited.

More specifically, in certain vehicle operating conditions, e.g. fast transient operating states caused by braking or accelerating sharply in gear, the torsional elasticity of the drive train causes the rotation speeds of the drive shaft and transmission output shaft to oscillate about the nominal values they should assume as a function of driver control and the engaged gear respectively.

More specifically, oscillations in rotation speed of the drive shaft are out of phase with respect to those of the transmission output shaft, and are greater in amplitude owing to the different moments of inertia of the engine and the vehicle as a whole to which the drive train is connected.

Though insignificant in terms of the mechanical effect on the drive train and engine, oscillations in rotation speed of the drive shaft and transmission output shaft may have serious repercussions in terms of vehicle control.

That is, the amplitude and phase shift of the oscillations in rotation speed of the drive shaft and transmission output shaft may cause the transmission ratio calculated by the central control unit to slip temporarily from the relative transmission ratio band, thus resulting in a faulty neutral state reading by the central control unit, and all the negative consequences this entails in terms of vehicle operation control.

To overcome this drawback, according to one aspect of the present invention, the amplitude of the transmission ratio bands is modulated as a function of the amplitude of the oscillations in rotation speed of the drive shaft and transmission output shaft. That is, the transmission ratio bands are widened in proportion to the amplitude of the oscillations.

More specifically, since the useful torque of the engine is the difference between the drive torque generated by combustion and the resisting torque acting on the engine and caused, among other things, by the torsional elasticity of the drive train, the amplitude of the oscillations in rotation speed of the drive shaft and transmission output shaft is determined by calculating the variation in the resisting torque acting on the engine.

More specifically, the variation in the resisting torque acting on the engine is determined by first calculating the variation in the useful torque of the engine, which, given the known linear relationship between torque and angular acceleration of the engine, is proportional to the second derivative of engine speed (the derivative is the difference between the current and preceding sample); and then subtracting from the variation in useful torque of the engine the variation in the combustion torque of the engine, i.e. the drive torque generated by fuel combustion, which is a quantity that can be calculated by the central control unit in known manner, therefore not described in detail, as a function of the amount of fuel injected by the electroinjectors.

Once the variation in the resisting torque acting on the engine is determined, its envelope is determined, and the amplitude of each transmission ratio band is increased in proportion to the ratio between the envelope of the variation in the resisting torque acting on the engine, and the moment of inertia of the engine.

More specifically, the upper limit of each transmission ratio band equals the sum of a constant contribution determined at the vehicle design stage, and a contribution proportional to the ratio between the envelope of the variation in the resisting torque acting on the engine, and the moment of inertia of the engine; and the lower limit of each transmission ratio band equals the difference between a constant contribution also determined at the vehicle design stage (and located symmetrically on the opposite side of the relative nominal transmission ratio with respect to the constant contribution of the upper limit), and a contribution proportional to the ratio between the envelope of the variation in the resisting torque acting on the engine, and the moment of inertia of the engine.

The proportion factor relating the width increase of the transmission ratio bands and the ratio between the envelope of the variation in the resisting torque acting on the engine and the inertia of the engine depends on the amplitude of the oscillations in rotation speed of the drive shaft and transmission output shaft, and therefore the mechanical characteristics of the drive train, and the desired increase in width of the transmission ratio bands.

The neutral state and in-gear state of the transmission are distinguished as follows.

At the end of the so-called engine cranking phase, the transmission is assumed to be in neutral; whereas, in all other cases, the neutral state of the transmission is determined when the transmission ratio calculated by the central control unit lies in one of the neutral bands (i.e. does not lie in any of the transmission ratio bands).

Transition from the neutral to in-gear state of the transmission, on the other hand, is only determined when both the following conditions occur simultaneously:

a) the transmission ratio calculated by the central control unit lies in a transmission ratio band;

b) the absolute value of the derivative of the transmission ratio calculated by the central control unit is below a given threshold value.

Condition b) is checked to prevent the central control unit from erroneously determining an in-gear state, when the transmission is actually in, and maintained in, neutral.

In fact, just after the transmission is shifted to and maintained in neutral, no power is transmitted from the engine to the vehicle wheels, so that the rotation speeds of the drive shaft and transmission output shaft evolve independently of each other, and the transmission ratio calculated by the central control unit can cross the transmission ratio bands relative to the other gears.

For example, when the vehicle travels along a flat road, the transmission ratio calculated by the central control unit decreases substantially steadily with time, and crosses all the transmission ratio bands of the gears lower than the one engaged prior to shifting to neutral.

Consequently, if transition from the neutral to an in-gear state were to be determined solely on the basis of the comparison in point a), whenever the transmission ratio calculated by the central control unit lies in a transmission ratio band as it crosses the transmission ratio bands of the gears lower than the one engaged prior to shifting to neutral, the central control unit would erroneously determine an in-gear state, when in actual fact the transmission is still in neutral.

The point b) check prevents this from happening, on condition, however, that the threshold value used in the point b) comparison is lower than the absolute value of the derivative of the transmission ratio calculated by the central control unit when the transmission is in neutral.

In fact, as stated with reference to the vehicle travelling along a flat road, when the transmission is shifted to neutral, the transmission ratio calculated by the central control unit decreases substantially steadily with time, so that its derivative assumes a constant value.

Therefore, by selecting a threshold value lower than the absolute value of the derivative of the transmission ratio calculated by the central control unit when the transmission is in neutral, whenever the transmission ratio calculated by the central control unit lies in a transmission ratio band as it crosses the transmission ratio bands of the gears lower than the one engaged prior to shifting to neutral, the condition in point a) is met, but not the one in point b), so the central control unit rightly continues to determine the neutral state.

As opposed to being constant, the threshold value used in the point b) comparison follows the same pattern as the transmission ratio band limits, i.e. is also modulated as a function of the amplitude of the oscillations in rotation speed of the drive shaft and transmission output shaft with respect to the values they should assume as a function of driver control and the gear engaged.

More specifically, the threshold value equals the sum of a constant contribution, and a contribution proportional to the ratio between the envelope of the variation in the resisting torque acting on the engine the moment of inertia of the engine.

In the light of what has been said concerning the point b) check preventing an in-gear state from being determined erroneously when in actual fact the transmission is in neutral, the constant contribution is selected as low as compatibly possible with the noise associated with the transmission ratio calculated when the transmission is in neutral.

In fact, when the transmission is in neutral, the vehicle and engine are disconnected, and the oscillations in rotation speed of the drive shaft and transmission output shaft about the values they should assume as a function of driver control and the engaged gear are zero, so that the threshold value coincides with the constant contribution and prevents an in-gear state from being determined erroneously.

The contribution proportional to the ratio between the envelope of the variation in the resisting torque acting on the engine and the moment of inertia of the engine provides for speeding up determination of the in-gear state. That is, when a gear is engaged so that, depending on whether the clutch is released sharply or not, the above oscillations may occur, the contribution proportional to the ratio between the envelope of the variation in the resisting torque acting on the engine and the moment of inertia of the engine increases the threshold value with respect to the value assumed in the neutral state, so that the absolute value of the derivative of the transmission ratio calculated by the central control unit takes less time to become lower than the threshold value, and the condition in point b) is therefore met faster than it the threshold value were to remain at the value assumed in the neutral state.

The proportion factor relating the increase in the threshold value and the ratio between the envelope of the variation in the resisting torque acting on the engine and the moment of inertia of the engine is therefore selected at the design stage on the basis of the above considerations.

FIGS. 15, 16, 17 and 18 show, by way of example, graphs of some of the above quantities when shifting gear, i.e. during a transient state in which the transmission is disconnected and then reconnected to the vehicle engine.

Figure 15:
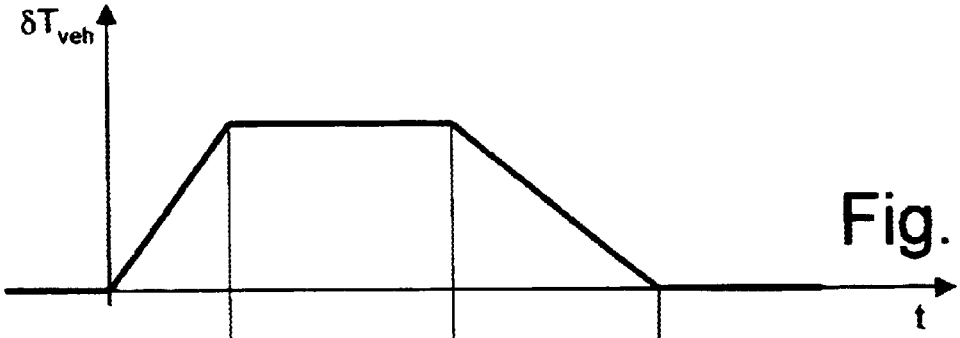
FIGS. 15–18 show graphs of quantities by which to determine the vehicle transmission gear engaged when shifting gear.
Figure 16:
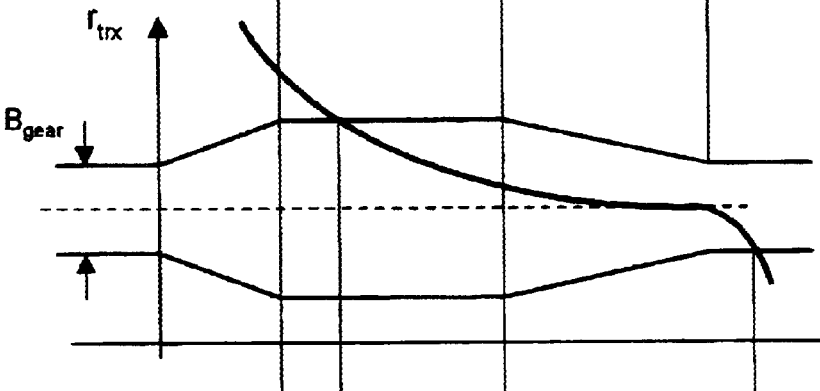
Figure 17:
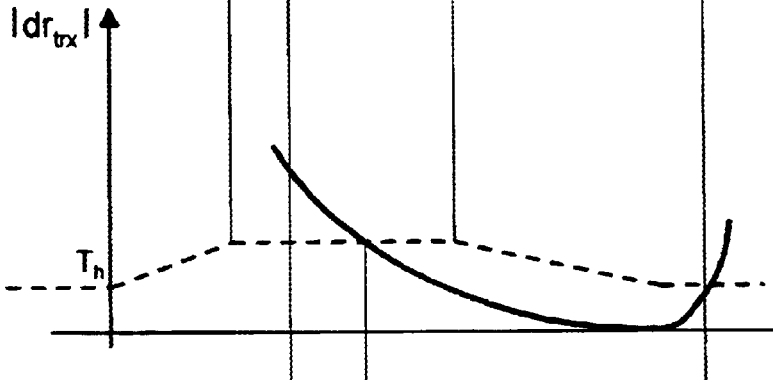

More specifically, FIG. 15 shows the variation in the resisting torque acting on the engine $\delta T_{veh}$; in FIG. 16, the bold line shows the transmission ratio calculated by the central control unit $r_{trx}$, the thin lines show the two limits of one of the transmission ratio bands indicated $B_{gear}$, and the dash line shows the nominal value of the transmission ratio of the transmission ratio band; in FIG. 17, the bold line shows the absolute value of the derivative of the transmission ratio calculated by the central control unit $|dr_{trx}|$, and the dash line shows the threshold value Th used in the point b) comparison described above; and FIG. 18 shows a time graph of the state (neutral or in-gear) determined by the central control unit.

As shown by comparing FIGS. 15 and 16, when shifting gear when the envelope of the variation in the resisting torque acting on the engine assumes a zero value, the transmission ratio band has a relatively low, constant amplitude, as in the known art; whereas, when the envelope of the variation in the resisting torque acting on the engine is other than zero, the transmission ratio band widens in proportion to the envelope.

On the other hand, as shown by comparing FIGS. 15 and 17, when shifting gear when the envelope of the variation in the resisting torque acting on the engine assumes a zero value, the threshold assumes a low value equal to the constant contribution assumed in the known art; whereas, when the envelope of the variation in the resisting torque acting on the engine assumes a value of other than zero, the threshold value increases in proportion to the envelope.

Figure 18:
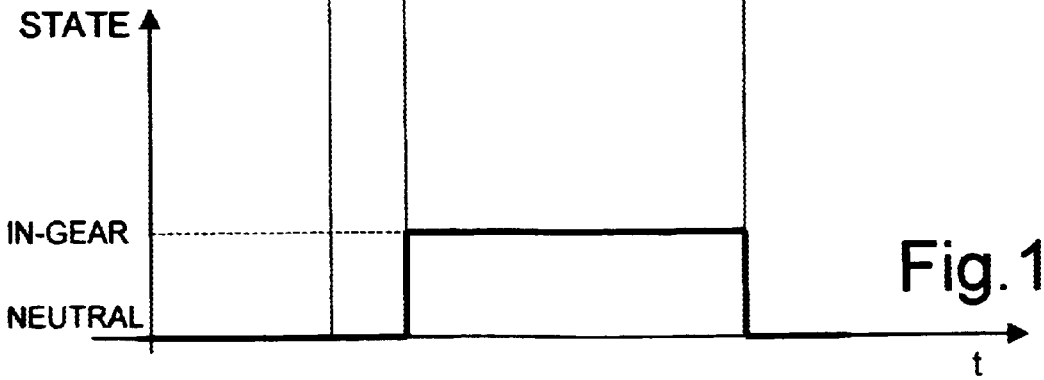
Figure 19:
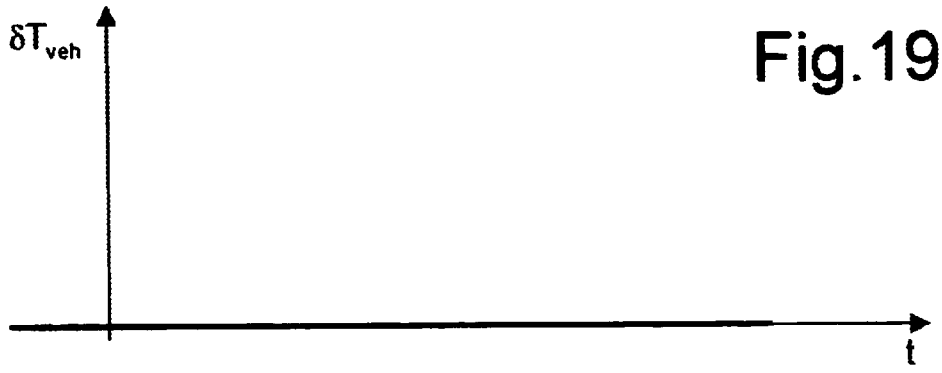
FIGS. 19–22 show graphs of quantities by which to determine the vehicle transmission gear engaged when running at minimum engine speed with the transmission in neutral.
Figure 20:
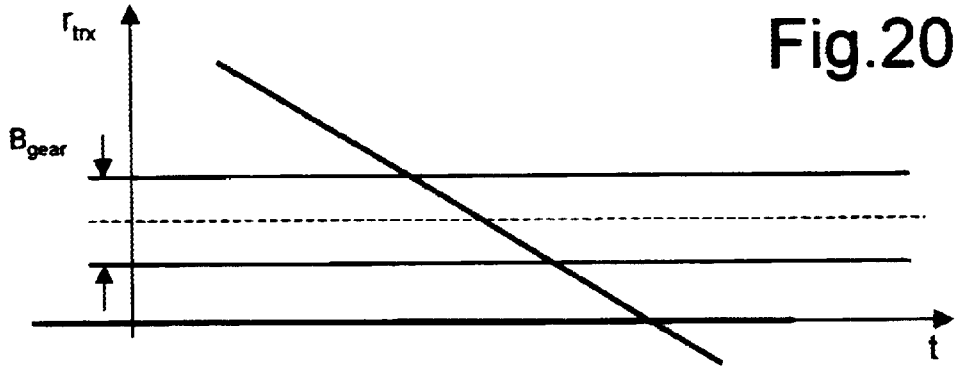
Figure 21:
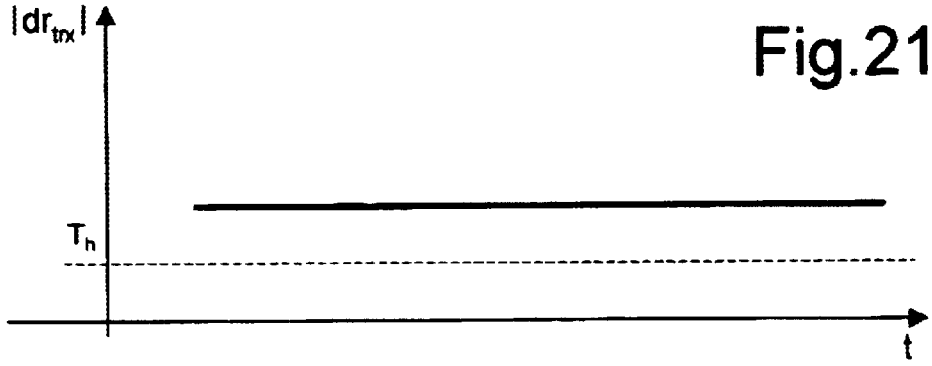
Figure 22:
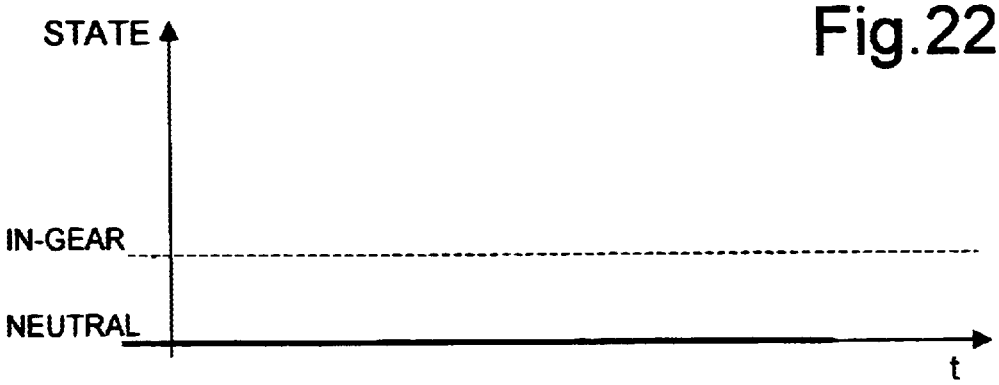

Finally, as shown by comparing FIGS. 17 and 18, when shifting gear when the absolute value of the derivative of the transmission ratio calculated by the central control unit is below the threshold value (point b) comparison), the central control unit determines completion of the gearshift, i.e. a complete transition from the neutral state following disengagement of the engaged gear, to the in-gear state.

FIGS. 19, 20, 21 and 22 show graphs of the same quantities as in FIGS. 15, 16, 17 and 18 respectively, but during idle motion of the vehicle, i.e. when the vehicle is moving but with the transmission in neutral, so that the speed of the drive shaft and the speed of the transmission output shaft evolve independently.

In this condition, the transmission is disconnected from the engine, so that none of the above oscillations in rotation speed of the drive shaft and transmission output shaft occur.

Consequently, the envelope of the variation in the resisting torque acting on the engine assumes a permanent zero value; the amplitude of the transmission ratio band remains at a constant low value; the threshold value coincides with the constant contribution; and the absolute value of the derivative of the transmission ratio calculated by the central control unit remains higher than the threshold value, so that the central control unit determines a neutral state.

When the transmission is in neutral, the amplitude of the transmission ratio bands depends on the respective gear, and typically ranges between ±2% of the respective nominal transmission ratio in fifth gear, and ±4% of the respective nominal transmission ratio in first gear.

Tests conducted by the Applicant have shown that widening the transmission ratio bands in proportion to the amplitude of the oscillations in rotation speed of the drive shaft and transmission output shaft about the nominal values they should assume as a function of driver control and the gear engaged provides for completely eliminating the drawbacks of the known state of the art, i.e. for preventing the central control unit from erroneously determining a neutral state on account of the above oscillations.

Moreover, in the absence of such oscillations, the amplitude of the transmission ratio bands is less than in the known art, thus improving its advantages. This, combined with the point b) check described above, greatly reduces, as compared with the known state of the art, the risk of erroneously determining an in-gear state.

Moreover, increasing the threshold value used in the point b) comparison in proportion to the amplitude of said oscillations, as opposed to the threshold value remaining constant at the lower value, greatly reduces the time taken by the central control unit to determine the transmission ratio band of the calculated transmission ratio.

The advantages of the present invention will be clear from the foregoing description.

In particular, tests conducted by the Applicant have shown the particular architecture of the FIG. 5 control device provides for overcoming many of the drawbacks typically associated with known control devices, and, in particular, for significant improvements in reducing undershooting in gear and shaking of the vehicle.

Clearly, changes may be made to the control device as described and illustrated herein without, however, departing from the scope of the present invention as defined in the accompanying claims.

What is claimed is:

1. A control device (10) for controlling the speed ($\omega_{eng}$) of an engine (1), characterized by comprising:

tracer means (13) which receive a target engine speed ($\omega_{targ}$) indicating the desired engine speed ($\omega_{eng}$), and a maximum engine torque ($T_{max}$), and supply a reference engine speed ($\omega_{ref}$) indicating the behaviour of the engine speed ($\omega_{eng}$) during a transient speed state towards said target engine speed ($\omega_{targ}$), and an open-loop torque ($T_{ol}$) indicating the drive torque which must be produced by said engine (1) during said transient speed state for the engine speed ($\omega_{eng}$) to follow said reference engine speed ($\omega_{ref}$);

observer means (14) which receive a measured engine speed ($\omega_{meas}$) indicating the engine speed ($\omega_{eng}$), and a combustion torque ($T_{cmb}$) indicating the drive torque generated by fuel combustion in said engine (1), and supply an observed engine speed ($\omega_{obs}$) representing an estimate of engine speed ($\omega_{eng}$) made on the basis of a system model (18) and as a function of said combustion torque ($T_{cmb}$) and said measured engine speed ($\omega_{meas}$), and an observed resisting torque ($R_{obs}$) representing an estimate of the total resisting torque acting on the drive shaft (2) of said engine (1) and made as a function of said observed engine speed ($\omega_{obs}$) and said measured engine speed ($\omega_{meas}$); and controller means (15) which receive said open-loop torque ($T_{ol}$), said reference engine speed ($\omega_{ref}$), said observed engine speed ($\omega_{obs}$), and said observed resisting torque ($R_{obs}$), and supply said combustion torque ($T_{cmb}$); said controller means (15) controlling said engine (1) so that the drive torque generated by fuel combustion equals said combustion torque ($T_{cmb}$).

2. A control device as claimed in claim 1, characterized in that said observer means (14) determine said observed engine speed ($\omega_{obs}$) and said observed resisting torque ($R_{obs}$)

as a function of the difference between said measured engine speed ($\omega_{meas}$) and the observed engine speed ($\omega_{obs}$) itself.

3. A control device as claimed in claim 1, characterized in that said observer means (14) comprise first adding means (16) which receive said measured engine speed ($\omega_{obs}$) and said observed engine speed ($\omega_{obs}$), and supply a first engine speed error ($\delta\omega_1$) related to the difference between the measured engine speed ($\omega_{meas}$) and the observed engine speed ($\omega_{obs}$); resisting torque estimating means (17) which receive said first engine speed error ($\delta\omega_1$), and supply said observed resisting torque ($R_{obs}$) and an instantaneous resisting torque ($R_{inst}$); and first system model means (18) which store said system model, receive said combustion torque ($T_{cmb}$) and said instantaneous resisting torque ($R_{inst}$), and supply said observed engine speed ($\omega_{obs}$).

4. A control device as claimed in claim 3, characterized in that said resisting torque estimating means (17) comprise first multiplication means (19) which receive said first engine speed error ($\delta\omega_1$), and supply an observed resisting torque variation ($\delta T_1$) related to the first engine speed error ($\delta\omega_1$) multiplied by a first multiplication coefficient ($K_1$); second adding means (20) which receive said observed resisting torque variation ($\delta T_1$) and said observed resisting torque ($R_{obs}$), and supply an updated resisting torque ($R_{up}$) related to the observed resisting torque ($R_{obs}$) plus the observed resisting torque variation ($\delta T_1$); delaying means (21) which receive said updated resisting torque ($R_{up}$), and supply said observed resisting torque ($R_{obs}$); second multiplication means (22) which receive said first engine speed error ($\delta\omega_1$), and supply an instantaneous resisting torque variation ($\delta T_2$) related to the first engine speed error ($\delta\omega_1$) multiplied by a second multiplication coefficient ($K_2$); and third adding means (23) which receive said observed resisting torque ($R_{obs}$) and said instantaneous resisting torque variation ($\delta T_2$), and supply said instantaneous resisting torque ($R_{inst}$) related to the observed resisting torque ($R_{obs}$) plus the instantaneous resisting torque variation ($\delta T_2$).

5. A control device as claimed in claim 1, characterized in that said tracer means (13) comprise torque outline generating means (24) which receive said maximum engine torque ($T_{max}$), said target engine speed ($\omega_{targ}$), said reference engine speed ($\omega_{ref}$), and an accelerator pedal position (APP), and supply said open-loop torque ($T_{ol}$); said open-loop torque ($T_{ol}$) having a trapezoidal outline with time when said reference engine speed ($\omega_{ref}$) differs from said target engine speed ($\omega_{targ}$); said tracer means (13) also comprising second system model means (25) which store said system model, receive said open-loop torque ($T_{ol}$), and supply said reference engine speed ($\omega_{ref}$).

6. A control device as claimed in claim 5, characterized in that said trapezoidal outline with time of said open-loop torque ($T_{ol}$) is defined by characteristic parameters comprising the maximum value ($T_{ol,max}$) assumable by the open-loop torque ($T_{ol}$), the slope ($\alpha_1$) of the ascending portion of the trapezoidal outline, and the slope ($\alpha_2$) of the descending portion of the trapezoidal outline; each of said characteristic parameters having a permissible variation range defined by a minimum value and a maximum value; and the value of each characteristic parameter being a function of the accelerator pedal position (APP).

7. A control device as claimed in claim 6, characterized in that the value of each said characteristic parameter is determined by linear interpolation of the respective pair of minimum and maximum values as a function of the accelerator pedal position (APP).

8. A control device as claimed in claim 6, characterized in that the minimum value and the maximum value defining the permissible variation range of each said characteristic parameter are a function of the engaged gear in a transmission (6) coupled to said engine (1).

9. A control device as claimed in claim 1, characterized in that said controller means (15) comprise fourth adding means (26) which receive said reference engine speed ($\omega_{ref}$) and said observed engine speed ($\omega_{obs}$), and supply a second engine speed error ($\delta\omega_2$) equal to the difference between the reference engine speed ($\omega_{ref}$) and the observed engine speed ($\omega_{obs}$); third multiplication means (27) which receive said second engine speed error ($\delta\omega_2$), and supply a proportional torque ($T_{prop}$) related to the second engine speed error ($\delta\omega_2$) multiplied by a third multiplication coefficient ($K_3$); fifth adding means (28) which receive said proportional torque ($T_{prop}$) and said observed resisting torque ($R_{obs}$), and supply a closed-loop torque ($T_{cl}$) related to the difference between the proportional torque ($T_{prop}$) and the observed resisting torque ($R_{obs}$); and sixth adding means (29) which receive said closed-loop torque ($T_{cl}$) and said open-loop torque ($T_{ol}$), and supply said combustion torque ($T_{cmb}$) related to the closed-loop torque ($T_{cl}$) plus the open-loop torque ($T_{ol}$).

10. A method of controlling the speed ($\omega_{eng}$) of an engine (1), characterized by comprising the steps of:

supplying a target engine speed ($\omega_{targ}$) indicating the desired engine speed ($\omega_{eng}$), and a maximum engine torque ($T_{max}$);

generating a measured engine speed ($\omega_{meas}$) indicating the engine speed ($\omega_{eng}$), and a combustion torque ($T_{cmb}$) indicating the drive torque generated by fuel combustion in said engine (1);

generating a reference engine speed ($\omega_{ref}$) indicating the behaviour of the engine speed ($\omega_{eng}$) during a transient speed state towards said target engine speed ($\omega_{targ}$), and an open-loop torque ($T_{ol}$) indicating the drive torque which must be produced by said engine (1) during said transient speed state for the engine speed ($\omega_{eng}$) to follow said reference engine speed ($\omega_{ref}$), as a function of said maximum engine torque ($T_{max}$) and said target engine speed ($\omega_{targ}$);

generating an observed engine speed ($\omega_{obs}$) representing an estimate of engine speed ($\omega_{eng}$) made on the basis of a system model (18) and as a function of said combustion torque ($T_{cmb}$) and said measured engine speed ($\omega_{meas}$), and an observed resisting torque ($R_{obs}$) representing an estimate of the total resisting torque acting on the drive shaft (2) of said engine (1) and made as a function of said observed engine speed ($\omega_{obs}$) and said measured engine speed ($\omega_{meas}$);

generating said combustion torque ($T_{cmb}$) as a function of said open-loop torque ($T_{ol}$), said reference engine speed ($\omega_{ref}$), said observed engine speed ($\omega_{obs}$), and said observed resisting torque ($R_{obs}$); and controlling said engine (1) so that the drive torque generated by fuel combustion equals said combustion torque ($T_{cmb}$).

* * * * *